US007185564B2

(12) United States Patent
Hsien

(10) Patent No.: US 7,185,564 B2
(45) Date of Patent: Mar. 6, 2007

(54) PIPE WRENCH HAVING A FIXED POSITIONING RING

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 94 days.

(21) Appl. No.: 11/091,511

(22) Filed: Mar. 29, 2005

(65) Prior Publication Data

US 2006/0219061 A1 Oct. 5, 2006

(51) Int. Cl.
*B25B 13/46* (2006.01)
*B25B 13/00* (2006.01)

(52) U.S. Cl. ..... 81/60; 81/58; 81/58.2

(58) Field of Classification Search ..... 81/60, 81/58, 58.2, 61; D8/25, 29
See application file for complete search history.

(56) References Cited

U.S. PATENT DOCUMENTS 2,401,128 A * 5/1946 Anderson ..... 81/58.2
2,699,082 A * 1/1955 Viets ..... 81/58.2
2,851,914 A * 9/1958 Zeckzer ..... 81/58.2
3,175,434 A * 3/1965 Bergquist ..... 81/58.2
4,479,409 A * 10/1984 Antonius ..... 81/58.3
5,388,479 A * 2/1995 Sroka ..... 81/58.2
5,417,129 A * 5/1995 Baron ..... 81/58.2
6,032,555 A * 3/2000 Whitley ..... 81/63.1
D427,866 S * 7/2000 Chabot ..... D8/28
6,382,051 B1 * 5/2002 Chang ..... 81/60
6,651,533 B1 * 11/2003 Hsien ..... 81/60
6,752,048 B1 * 6/2004 Chiang ..... 81/63.1
6,928,904 B2 * 8/2005 Hsien ..... 81/60

* cited by examiner

*Primary Examiner*—Lee D. Wilson
*Assistant Examiner*—Alvin J. Grant

(57) ABSTRACT

A ratchet pipe wrench a C-shaped head including two jaws and a ratchet mechanism is received in the head so as to engage with a C-shaped engaging member rotatably engaged with the space between the two jaws of the head. A C-shaped positioning ring is securely engaged with a groove defined in an inside of the two jaws of the head so that only the engaging member is rotatable relative to the head.

6 Claims, 14 Drawing Sheets

PIPE WRENCH HAVING A FIXED POSITIONING RING

FIELD OF THE INVENTION

The present invention relates to a ratchet pipe wrench that has a C-shaped head and a C-shaped engaging member which is rotatably engaged with the head and a C-shaped positioning ring is securely connected to the head and retains the engaging member.

BACKGROUND OF THE INVENTION

A conventional wrench used on piping system is shown in FIG. 1 and an inherent shortcoming is that the jaws of the conventional wrench are wide and thick and the pipes are located very close to each other so that when rotating the wrench the jaws are blocked by the pipes around the object. FIG. 2 shows a conventional box end wrench that has thinner ring portion so that the wrench is convenient to rotate among the pipes. Nevertheless, the conventional wrench has to be disengaged from the object after it is rotated an angle which is limited especially when the space between the pipes is narrow. The frequent disengagement and engagement of the wrench and the object take a lot of time and reduce the efficiency of the work.

Other disclosed references known to the applicant are U.S. Pat. No. 2,401,128, U.S. Pat. No. 2,699,082, U.S. Pat. No. 6,382,051, U.S. Pat. No. 6,651,533, and U.S. Pat. No. 6,408,722.

The present invention intends to provide a ratchet pipe wrench wherein a C-shaped positioning ring is engaged with the head and secures the C-shaped engaging member in the head.

SUMMARY OF THE INVENTION

In accordance with one aspect of the present invention, there is provided a ratchet pipe wrench which comprises a C-shaped head including two jaws and a ratchet mechanism is received in the head. A C-shaped engaging member is rotatably engaged with the space between the two jaws of the head engaged with the ratchet mechanism. A C-shaped positioning ring is securely engaged with a groove defined in an inside of the two jaws of the head so as to retain the positioning ring from being rotated together with the engaging member.

The primary object of the present invention is to provide a ratchet pipe wrench which can be operated in a narrow space and the engaging member is retained by a C-shaped positioning ring which is fixed to the inside of the head.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
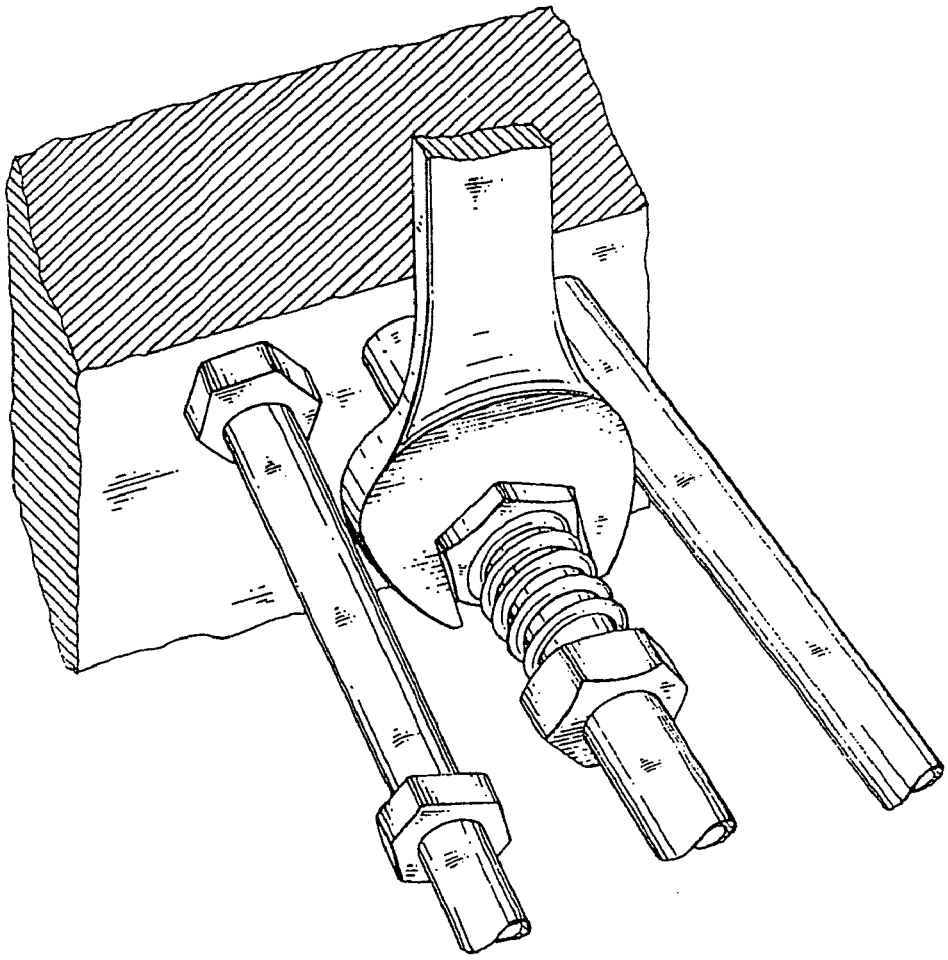
FIG. 1 PRIOR ART
FIG. 1 shows a conventional wrench and a piping system.
Figure 2:
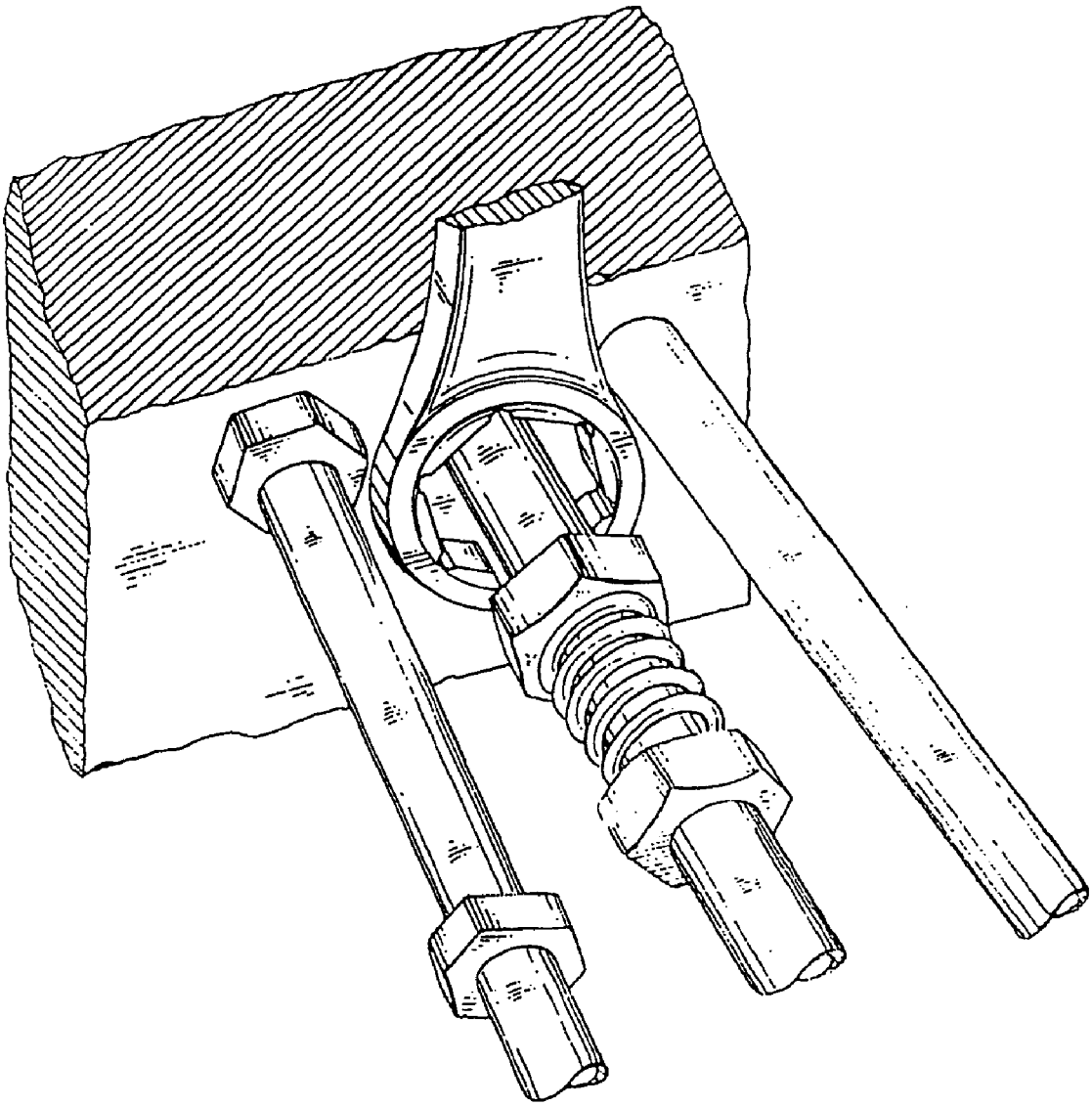
FIG. 2 PRIOR ART
FIG. 2 shows a conventional pipe wrench and a pipe system.
Figure 3:
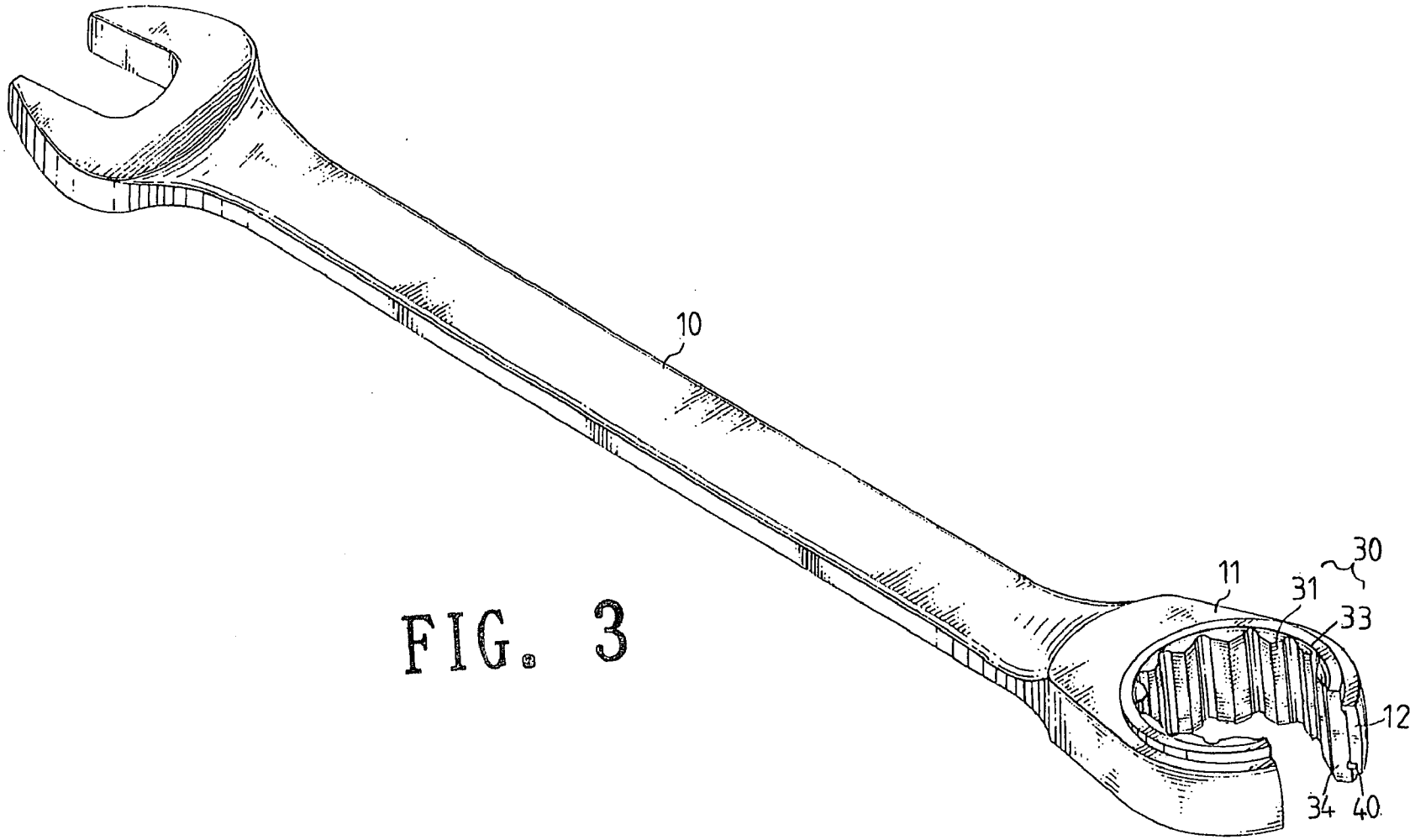
FIG. 3 is a perspective view to show the pipe wrench of the present invention.
Figure 4:
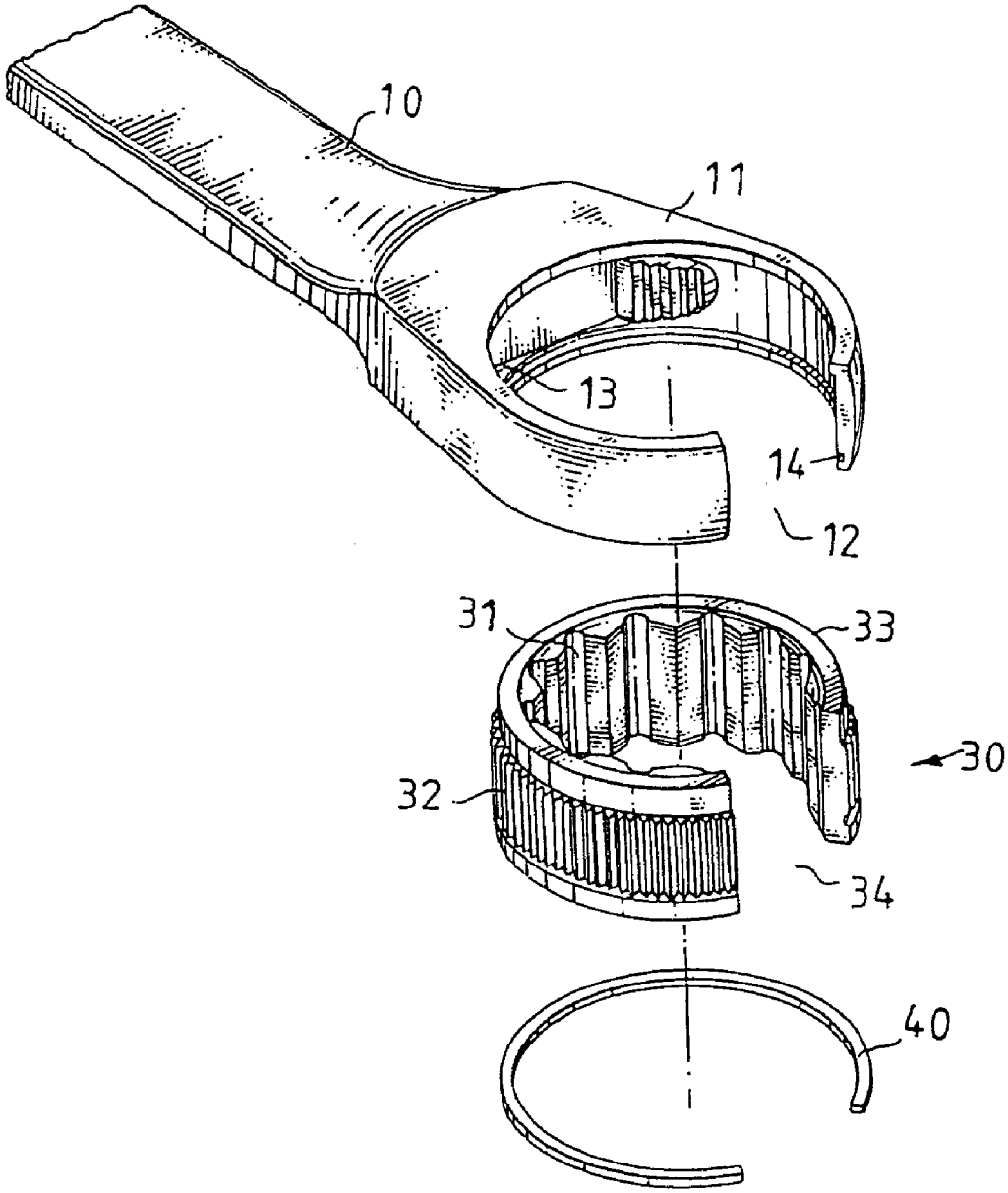
FIG. 4 is an exploded view to show a pipe wrench of the present invention.

Referring to FIGS. 3 and 4, the ratchet pipe wrench 10 of the present invention comprises a C-shaped head 11 including two jaws and a ratchet mechanism is received in a passage 13 in the head 11. The ratchet mechanism includes a pawl which has a toothed surface exposed in the inside of the head 11.

Figure 12:
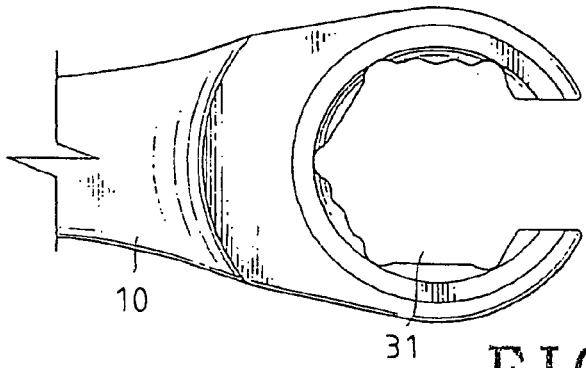
FIGS. 10 to 12 show the shapes of inside of the engaging member of the wrench.
Figure 11:
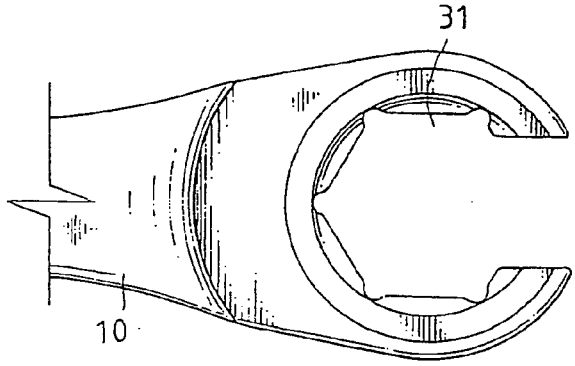
Figure 10:
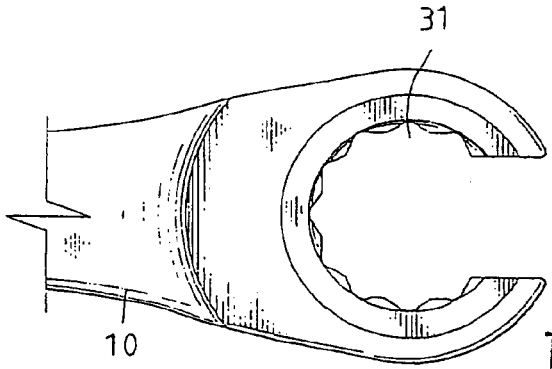

A C-shaped engaging member 30 is rotatably engaged with the space between the two jaws of the head 11 and has a toothed outer surface 32 which is engaged with the toothed surface of the pawl of the ratchet mechanism. The engaging member 30 has a polygonal inside 31 which can be the shapes as shown in FIGS. 10 to 12 which are known in the art and may clamp a rounded nut.

Figure 5:
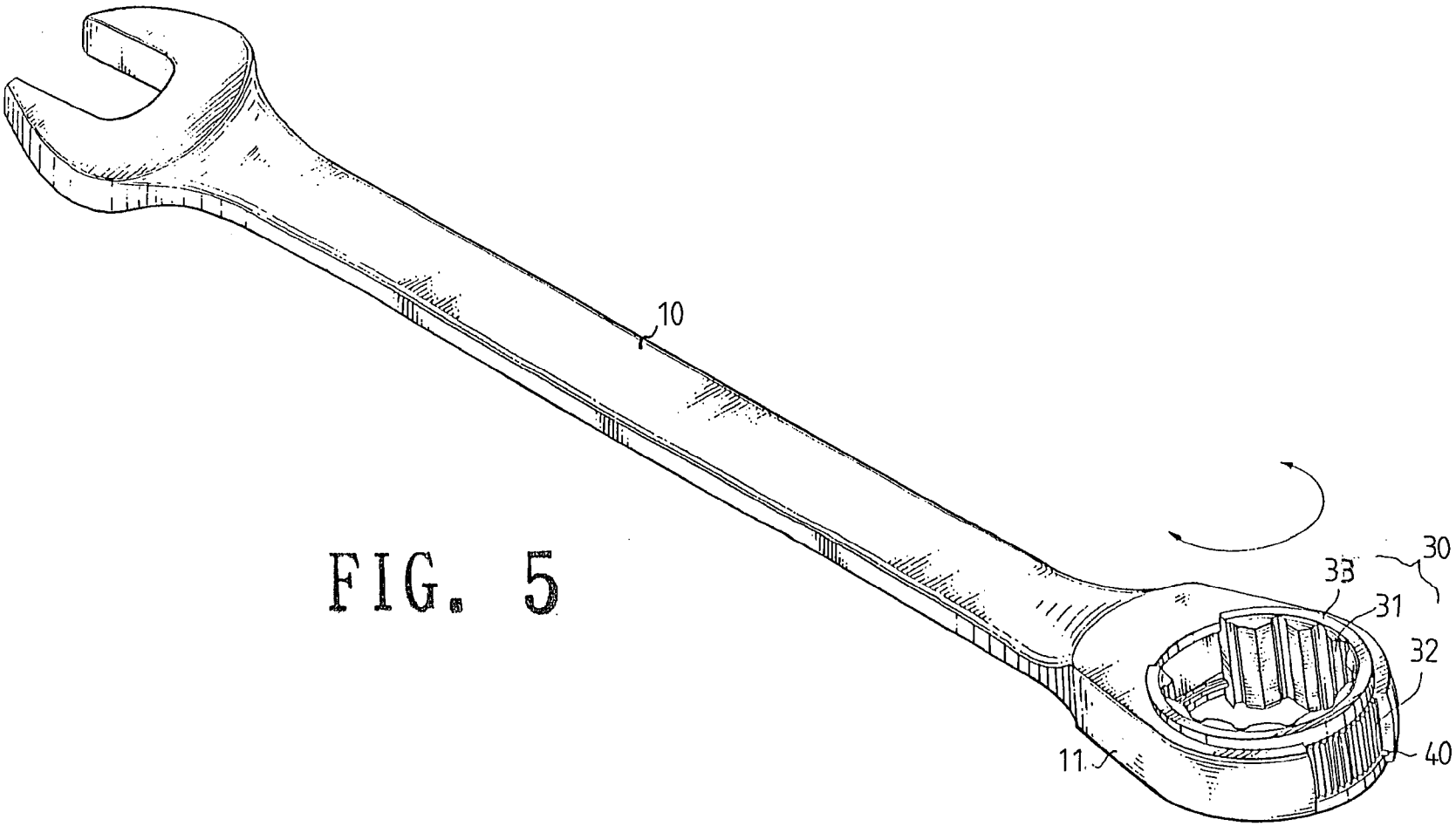
FIG. 5 is a perspective view to show the pipe wrench of the present invention, wherein the engaging member is rotated relative to the head.
Figure 6:
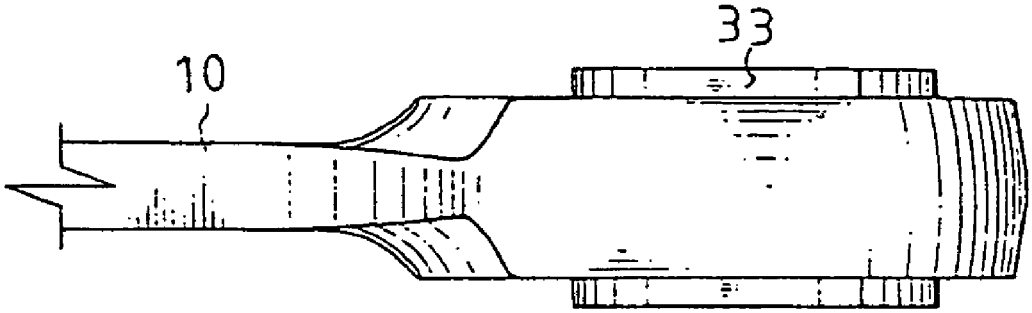
FIGS. 6 to 8 show the different shapes of the flange of the engaging member.
Figure 7:
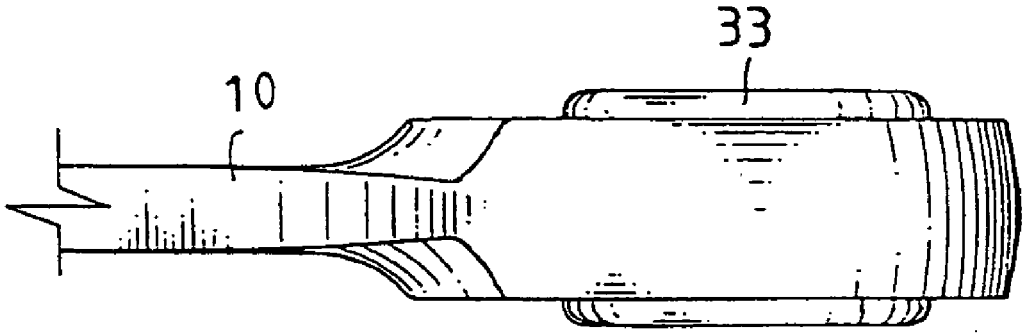
Figure 8:
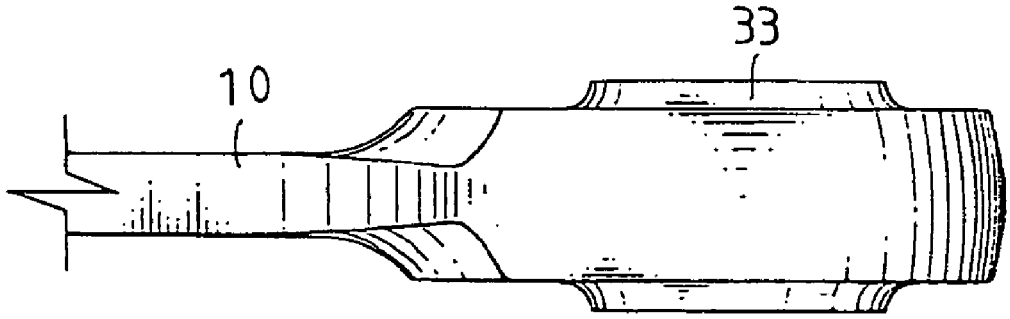
Figure 9:
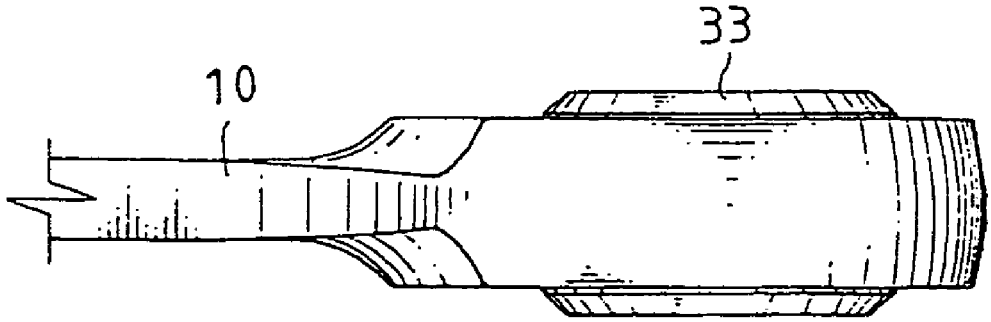

A C-shaped positioning ring 40 securely engaged with a groove 14 defined in an inside of the two jaws of the head 11 so as to retain the engaging member 30 from disengaging from the head 11. The positioning ring 40 is fixed to the head 11 and is not rotated relative to the head 11 while the engaging member 30 is rotated relative to the head 11 as shown in FIG. 5. A flange 33 extends from a side of the engaging member 30 and protrudes from a surface of the head 11 so that the user may rotate the flange 33 to adjust the opening 34 of the engaging member 30 to be in alignment with the opening 12 of the head 11 to allow the head 11 to disengage from the object (not shown) to be clamped. The configuration of the flange 33 can be different such as polygonal or any other shape that is convenient for the user to hold and to rotate. FIGS. 6 to 9 show several possible shapes of the flange 33.

Figure 14:
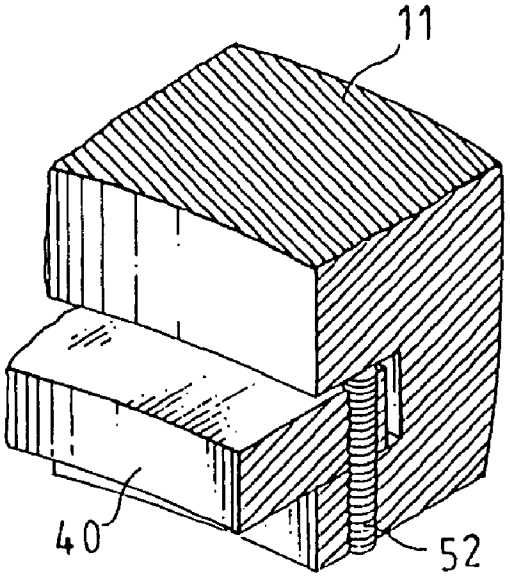
FIG. 14 shows the positioning ring is securely engaged with the groove by the screw.
Figure 13:
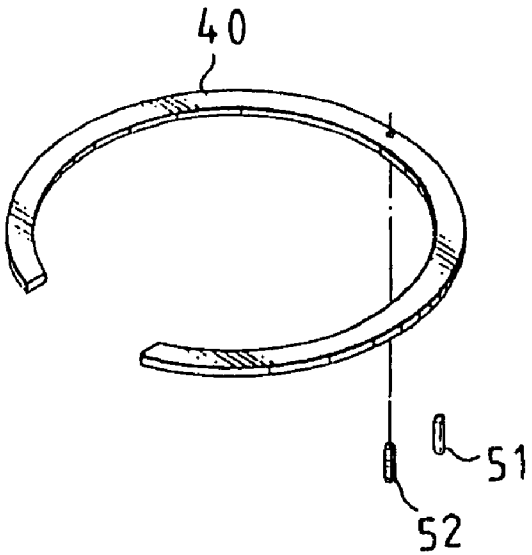
FIG. 13 shows a pin or a screw is to be penetrated through the positioning ring.
Figure 16:
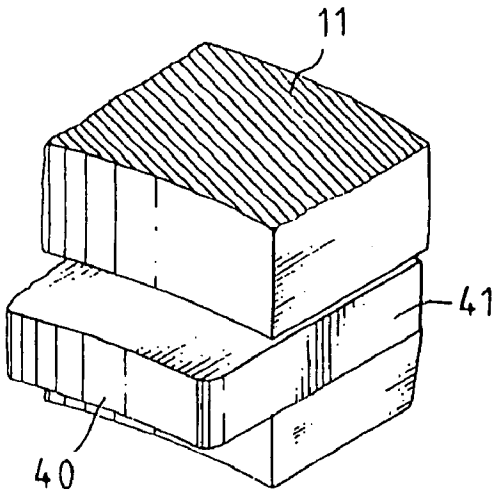
FIG. 16 shows that the tongue of the engaging ring is engaged with the notch in the head.
Figure 15:
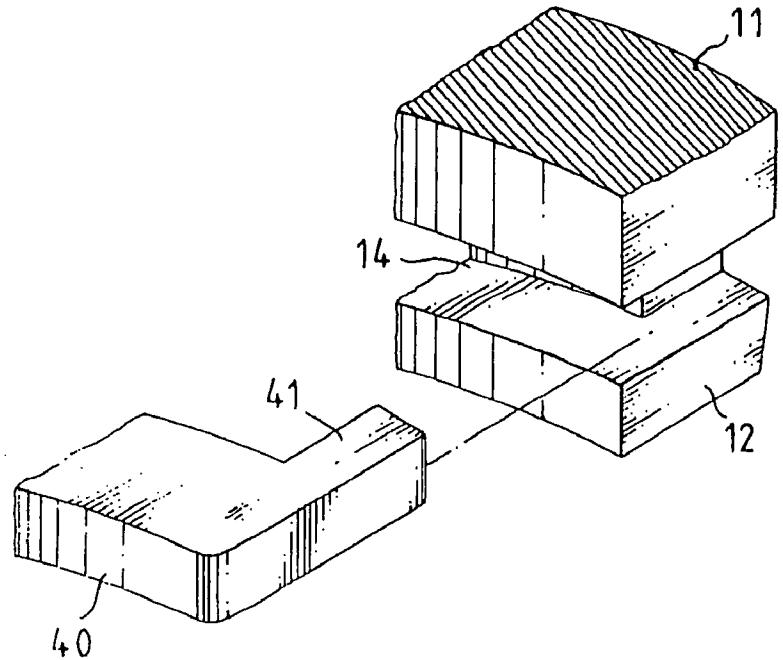
FIG. 15 is an exploded view to show the ring has a tongue to be inserted in a notch in the head.
Figure 18:
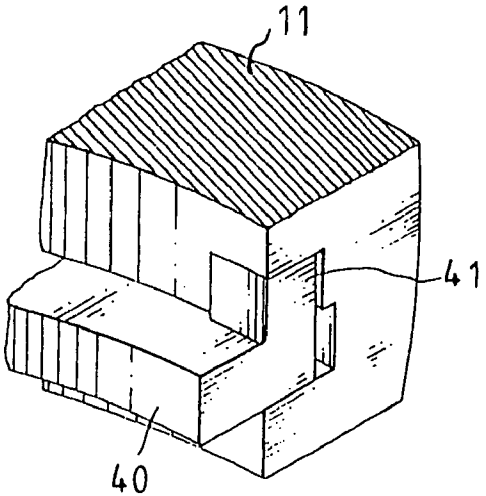
FIG. 18 shows that the tongue in FIG. 17 is engaged with the notch in the head.
Figure 17:
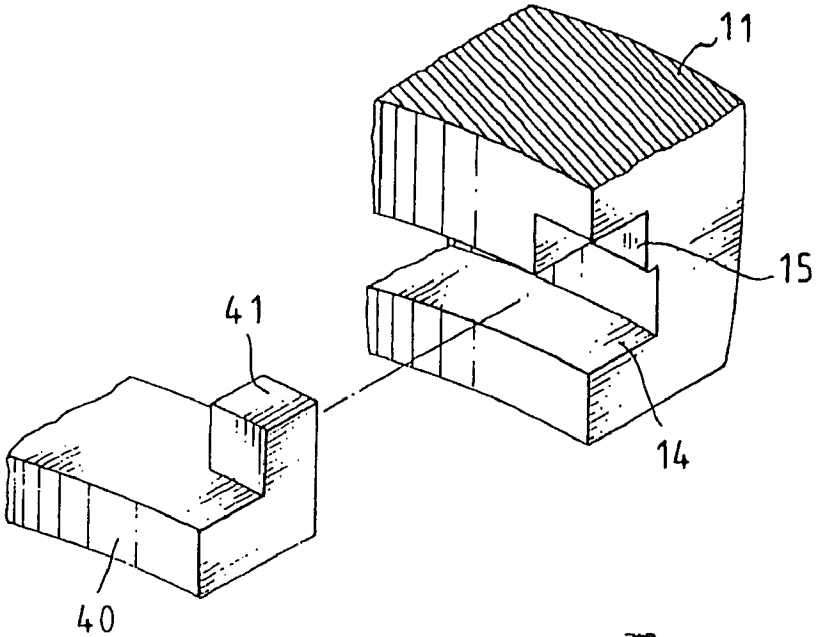
FIG. 17 is an exploded view to show another embodiment of the tongue of the positioning ring.
Figure 19:
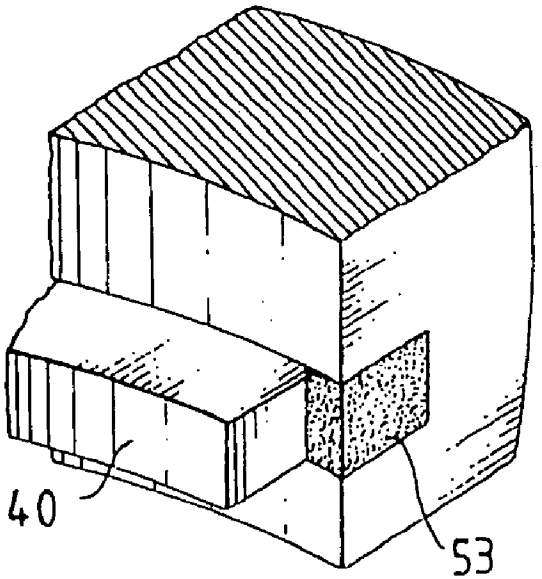
FIG. 19 shows a piece is adhered in the groove so as to prevent the positioning ring from dropping.
Figure 20:
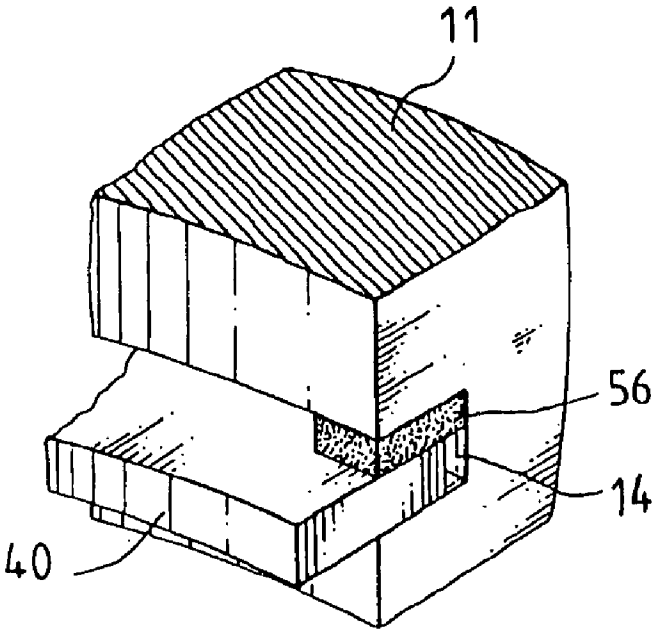
FIG. 20 shows a friction member force-fitted in the groove to secure the positioning ring.
Figure 21:
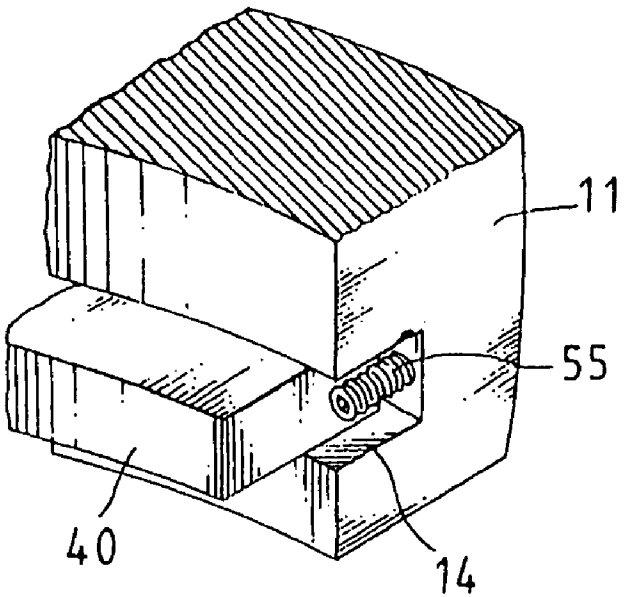
FIGS. 21 and 22 show two different types of stop member in the groove.
Figure 22:
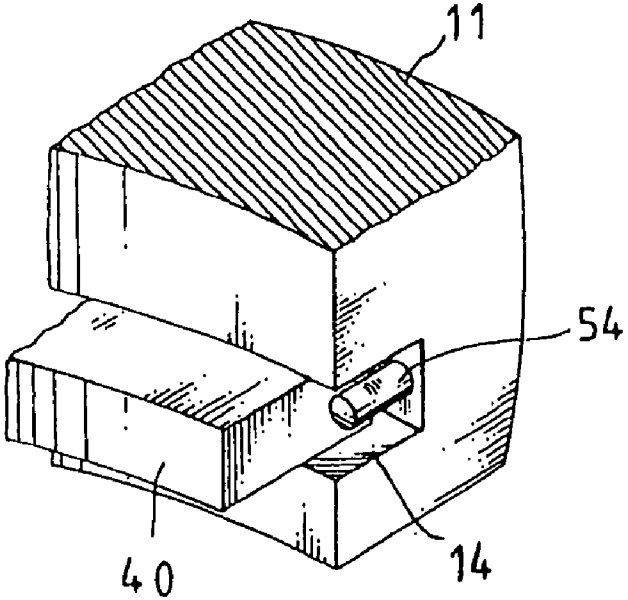
Figure 23:
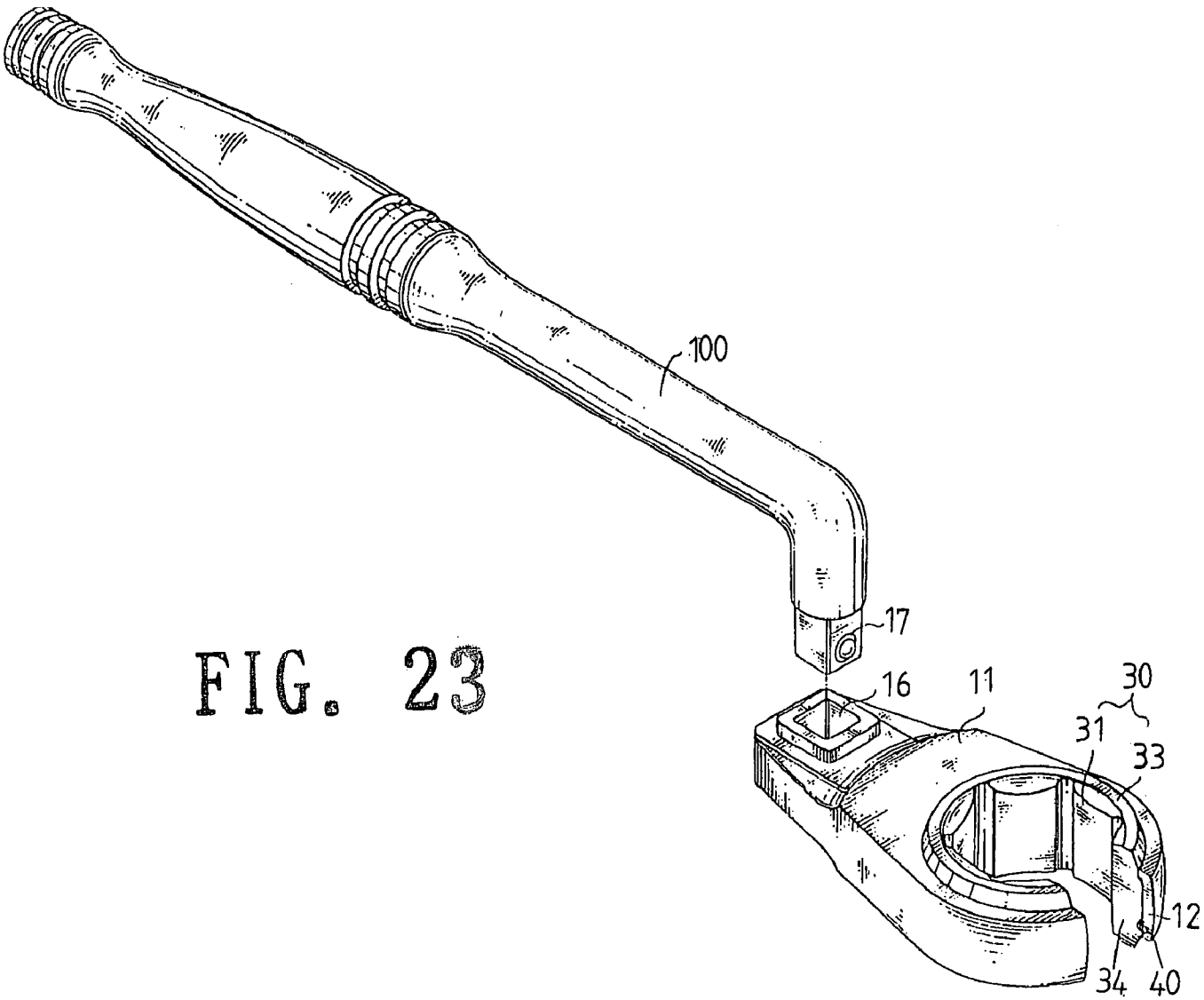
FIG. 23 shows a shank disengageably connected to the head.

FIGS. 13 and 14 show that a pin 51 or a screw 52 extends through the head 11 and the positioning ring 40 to securely position the positioning ring 40. FIGS. 15 and 16 show another embodiment to position the positioning ring 40 wherein a notch 12 is defined in an inside of the groove 14 and the positioning ring 40 has a tongue 41 which is engaged with the notch 12. FIGS. 17 and 18 show that the notch 15 may be extended inward and upward and the tongue 41 has a corresponding shape so as to be engaged with the notch 15. FIG. 19 shows a stop member 53 which is adhered in the groove 14 and located at an end of the C-shaped positioning ring 40 to prevent the positioning ring 40 from moving relative to the head 11. FIG. 20 shows a friction member 56 is force-fitted in the groove 14 to secure the positioning ring 40. FIGS. 21 and 22 show that a stop member 54/55 extending from an inside of the groove 14 and is located close one of two ends of the positioning ring 40 so as to prevent the positioning ring 40 from being displaced from the groove 14.

While we have shown and described the embodiment in accordance with the present invention, it should be clear to those skilled in the art that further embodiments may be made without departing from the scope of the present invention.

What is claimed is:

1. A pipe wrench comprising:

a C-shaped head including two jaws and a ratchet mechanism received in the head, a hole defined in a side of the head and a shank having an insertion end which is inserted in the hole;

a C-shaped engaging member rotatably engaged with a space between the two jaws of the head and having a toothed outer surface which is engaged with the ratchet mechanism, a flange extending from a side of the engaging member and protruding from a surface of the head, and a C-shaped positioning ring securely engaged with a groove defined in an inside of the two jaws of the head.

2. The pipe wrench as claimed in claim 1 further comprising a screw extending through the head and the positioning ring.

3. The pipe wrench as claimed in claim 1, wherein a notch is defined in an inside of the groove and the positioning ring has a tongue which is engaged with the notch.

4. The pipe wrench as claimed in claim 1, wherein a friction member is force-fitted in the groove to secure the positioning ring.

5. The pipe wrench as claimed in claim 1, wherein a stop member extends from an inside of the groove and is located close to one of two ends of the positioning ring so as to prevent the positioning ring from being displaced from the groove.

6. A ratchet pipe wrench comprising:

a C-shaped head including two jaws and a ratchet mechanism received in the head;

a C-shaped engaging member rotatably engaged with a space between the two jaws of the head and having a toothed outer surface which is engaged with the ratchet mechanism, a flange extending from a side of the engaging member and protruding from a surface of the head, and a C-shaped positioning ring securely engaged with a groove defined in an inside of the two jaws of the head, a notch defined in an inside of the groove and the positioning ring having a tongue which is engaged with the notch, a screw extending through the head and the positioning ring so as to position the positioning ring.

* * * * *